US005585906A

United States Patent [19]

Takahashi et al.

[11] Patent Number: 5,585,906

[45] Date of Patent: Dec. 17, 1996

[54] AN IMAGE FORMING APPARATUS WITH A DEVICE FOR CONVEYING AN IMAGE RECEIVING MEMBER

[75] Inventors: Masashi Takahashi; Toshihiro Kasai, both of Kanagawa-ken; Minoru Yoshida, Tokyo, all of Japan

[73] Assignee: Kabushiki Kaisha Toshiba, Kawasaki, Japan

[21] Appl. No.: 405,810

[22] Filed: Mar. 16, 1995

[30] Foreign Application Priority Data

Mar. 22, 1994 [JP] Japan ..... 6-050141

[51] Int. Cl.[6] ..... G03G 15/14; G03G 15/16

[52] U.S. Cl. ..... 355/273; 355/271; 355/274; 355/326 R; 355/327

[58] Field of Search ..... 355/271, 273, 355/272, 274, 275, 276, 277, 326 R, 327, 328

[56] References Cited

U.S. PATENT DOCUMENTS

| | | | |
|---|---|---|---|
| 4,162,843 | 7/1979 | Inoue et al. | 355/327 |
| 4,825,256 | 4/1989 | Nakai et al. | 355/326 K |
| 5,113,226 | 5/1992 | Tadokoro et al. | 355/273 |
| 5,159,392 | 10/1992 | Kasahara et al. | 355/274 |
| 5,172,173 | 12/1992 | Goto et al. | 355/275 |
| 5,281,981 | 1/1994 | Kajita | 355/327 X |
| 5,335,052 | 8/1994 | Sato et al. | 355/271 |
| 5,390,012 | 2/1995 | Miyashiro et al. | 355/273 |
| 5,469,248 | 11/1995 | Fujiwara et al. | 355/326 R |

FOREIGN PATENT DOCUMENTS

| | | | |
|---|---|---|---|
| 0076768 | 5/1985 | Japan | 355/326 A |
| 0039063 | 2/1990 | Japan | 355/326 A |
| 0038526 | 3/1990 | Japan | 355/327 A |
| 3-181979 | 8/1991 | Japan . | |

*Primary Examiner*—Matthew S. Smith
*Attorney, Agent, or Firm*—Foley & Lardner

[57] ABSTRACT

This apparatus forms a multiplex image on a sheet of paper conveyed on a conveyor belt through a plurality of image forming stations and prevents any misregistration between the images on the paper by using a first charger to charge the conveyor belt and a second charger for charging the paper on the conveyor belt. The first charger supplies the conveyor belt with an electrical charge of a predetermined polarity before the paper is supplied thereon. The second charger charges the paper on the conveyor belt with an electrical charge of a polarity opposite to the predetermined polarity.

5 Claims, 5 Drawing Sheets

AN IMAGE FORMING APPARATUS WITH A DEVICE FOR CONVEYING AN IMAGE RECEIVING MEMBER

BACKGROUND OF THE INVENTION

1. Field of the Invention

The present invention relates to an image forming apparatus in which a plurality of images are superposed on an image receiving member conveyed on a conveyor belt through a plurality of image forming stations.

2. Description of the Related Art

The Japanese Patent publication (Kokai) No. 3-181979 discloses a means to adhere the sheet-like transfer medium to the conveyor belt in an image forming apparatus. According to this means, a conductive roller is provided in contact with the transfer medium and a power supply applies a bias voltage to the conductive roller. The transfer medium is supplied with an electrical charge and therefore is adhered on the conveyor belt electrostatically. The adhered transfer medium is transferred forward to an image forming station, where an image formed on an image carrier is transferred onto the transfer medium.

However, this method has a problem that the transfer medium could not be sufficiently adhered when an electrical resistance of the transfer medium had dropped during a highly humidity condition. To solve this problem, it can be considered to increase the bias voltage to be applied to the conductive roller, but in this case there is also such a problem that a power supply of high voltage is required and an increase of size/manufacturing cost of the apparatus may result.

The transfer medium moves on the conveyor belt if not fully adhered, therefore it is difficult to form a color image which is formed by the passage of the transfer medium through a plurality of image forming stations, as misregistration among the images on the transfer medium occurs.

SUMMARY OF THE INVENTION

It is therefore an object of the present invention to provide an improved image forming apparatus.

It is also an object of the present invention to provide an image receiving member transferring device to convey the image receiving member while adhering the image receiving member thereon sufficiently without using an excessive high power supply.

It is an another object of the present invention to provide an image forming apparatus to prevent any image misregistration from occuring on the image receiving member when multiple images are superposed on the image receiving member successively.

In accordance with one aspect of the present invention, the foregoing objects are achieved by providing an image forming apparatus which forms an image on the image receiving member. The image forming apparatus includes an image forming station for forming the image on the image receiving member; means for conveying the image receiving member to the image forming station while supporting the image receiving member thereon; means for charging the conveying means by supplying a first electrical charge of a predetermined polarity to the conveying means; means for supplying the image receiving member onto the conveying means charged by the charging means; means for adhering the image receiving member supplied by the supplying means onto the conveying means by supplying a second electrical charge of a polarity opposite to the predetermined polarity.

In accordance with another aspect of the present invention, there has been provided an image forming apparatus for forming an image on an image receiving member. The image forming apparatus includes means for forming the image on an image carrier; means confronting the image carrier, for transferring the image formed on the image carrier onto the image receiving member; means for conveying the image receiving member to the transferring means while supporting the image receiving member thereon; means for charging the conveying means by supplying a first electrical charge of a predetermined polarity to the conveying means; means for supplying the image receiving member onto the conveying means charged by the charging means; means for adhering the image receiving member supplied by the supplying means onto the conveying means by supplying a second electrical charge of a polarity opposite to the predetermined polarity.

In accordance with still another aspect of the present invention, there has been provided a method for forming an image on an image receiving member supported on a conveying means. The image forming method includes the steps of forming the image on an image carrier; charging the conveying means with a first electrical charge of a predetermined polarity; supplying the image receiving member onto the charged conveying means; adhering the supplied image receiving member to the conveying means by charging the image receiving member with a second electrical charge of a polarity opposite to the predetermined polarity; conveying the adhered image receiving member to the image carrier on which the image is formed; transferring the image on the image carrier onto the conveyed image receiving member.

BRIEF DESCRIPTION OF THE DRAWINGS

A more complete appreciation of the present invention and many of the attendant advantages thereof will be readily obtained as the invention becomes better understood by reference to the following detailed description, when considered in connection with the accompanying drawings, wherein.

DETAILED DESCRIPTION OF THE PREFERRED EMBODIMENTS

Figure 1:
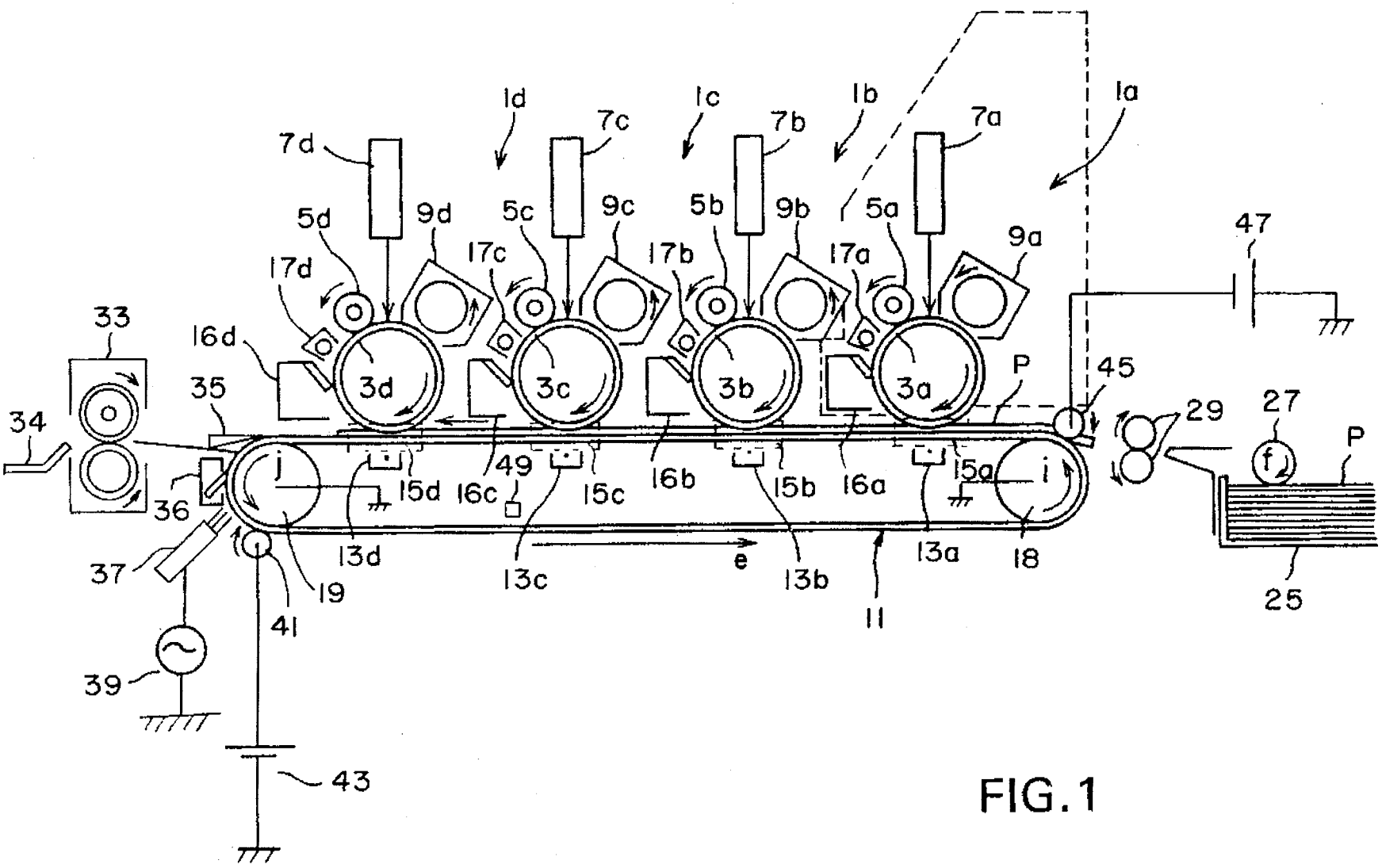
FIG. 1 is a sectional view showing the image forming apparatus of the present invention.

FIG. 1 shows an image forming apparatus with four image processing units 1*a*, 1*b*, 1*c* and 1*d* as a plurality of the image forming means according to the first embodiment.

A photosensitive drum 3*a* as an image carrier is provided rotatably as indicated by the arrow in processing unit 1*a*.

A charging roller 5a, an exposure station 7a, a developing device 9a, and a conveyor belt 11 are arranged along a rotating direction of the photosensitive drum 3a around the photosensitive drum 3a.

The charging roller 5a includes a conductive rubber roller and is provided in contact with the surface of the photosensitive drum 3a for charging the photosensitive drum 3a uniformly. The exposure station 7a exposes the charged photosensitive drum 3a to form an electrostatic latent image. At the downstream side of the exposure station 7a, the developing device 9a containing yellow developer is provided for developing the latent image. At the downstream side of the developing device 9a, the conveyor belt 11 is provided as a means for conveying an image receiving member, for example paper P, to the photosensitive drum 3a.

A corona charger 13a for transferring an image on the image carrier 3a onto the paper P is provided to confront the image carrier 3a through the conveyor belt 11, whereby a transfer station 15a for forming an image on the paper P is formed between the drum 3a and the corona charger 13a. At the downstream side of the corona charger 13a, a cleaning device 16a and a discharge lamp 17a are arranged. The cleaning device 16a is for cleaning the developer remaining on the photosensitive drum 3a after a transfer of the image in the transfer station 15a, and the discharge lamp 17a is for discharging the surface of the drum 3a. With the discharge by the discharge lamp 17a, a cycle for the image forming process is completed. The uncharged photosensitive drum 3a will be charged again by the charging roller 5a in the next image forming cycle.

The conveyor belt 11 is an endless belt and is passed over a tension roller 18 and a driving roller 19 for supporting and moving the conveyor belt 11. The distance between the tension roller 18 and the driving roller 19 is approximate 300 mm. The driving roller 19 is rotatively driven by a drive source, not shown, and the tension roller 18 rotates following the rotation of the driving roller 19 to supply tension force to the conveyor belt 11.

The conveyor belt 11 perform the function of conveying the image receiving member and enables transfer of the image on the image carrier onto the image receiving member. To enable these functions, the conveyor belt of the embodiment is made of thermosetting polyimide and is formed in a seamless ring shape, 270 mm in width, 80 mm in diameter, 100 μm in thickness and $10^{14}$ Ωcm in electrical resistance. As a material of the conveyor belt 11, such resins as polycarbonate, polyethylene terephthalate, polytetrafluoroethylene, polyvinylidene fluoride and so on can be used.

The conveyor belt 11 is moved as indicated by the arrow in the direction e by the rotation of the tension roller 18 and the driving roller 19. The moving speed is controlled at a magnitude equal to the rotational speed of the photosensitive drum 3a.

Along the moving direction of the conveyor belt 11, the image processing units 1a, 1b, 1c and 1d are arranged horizontally between the tension roller 18 and the driving roller 19.

The processing units 1b, 1c and 1d are all of similar construction as that of the processing unit 1a. That is, photosensitive drums 3b, 3c and 3d are provided at almost the center of the respective processing units. Around the photosensitive drums, charging rollers 5b, 5c and 5d, exposure stations 7b, 7c and 7d, and developing devices 9b, 9c and 9d, corona chargers 13b, 13c, 13d and etc. are arranged in a similar way to the arrangememt around the photosensitive drum 3a. Between the corona charger 13b and the drum 3b, an image forming station 15b is formed, between the corona charger 13c and the drum 3c, an image forming station 15c is formed, between the corona charger 13d and the drum 3d, an image forming station 15d is formed. The corona chargers 13a, 13b, 13c and 13d are connected to a power supply, not shown, respectively. Only one difference in the respective processing units is a developer in the developing device, that is, developing devices 9b, 9c, 9d contain magenta developer, cyan developer, black developer, respectively, instead of yellow developer.

A paper supply cassette 25 for supplying the paper P on the conveyor belt 11 is disposed on the right side of the conveyor belt 11. This paper supply cassette 25 is provided with a pick-up roller 27 rotatably as shown by the arrow f for picking up one paper from the paper supply cassette 25. A pair of aligning rollers 29 is provided between the paper supply cassette 25 and the conveyor belt 11 to send the paper P picked up by the pick-up roller 27 onto the conveyor belt 11.

An image fixing device 33 for fixing the image formed on the paper P and a paper tray 34 for accepting discharged paper from the fixing device 33 are arranged on the left side of the conveyor belt 11.

A separating device 35 for separating paper P from the conveyor belt 11 is disposed between the fixing device 33 and the last image forming station 15d.

A cleaning device 36 is provided near the driving roller 19 in contact with the conveyor belt 11 for removing developer, etc. adhered to the conveyor belt 11. Further, at the downstream side of the cleaning device 36 along the moving direction of the conveyor belt 11, a discharge device 37 is provided for discharging the conveyor belt 11 which has been charged by the corona chargers 13a, 13b, 13c and 13d during the image transfer. The discharge device 37 is connected to an AC power supply 39. In the embodiment, a brush in contact with the conveyor belt 11 is provided as a discharging member and to the brush is applied an AC bias voltage of 3 kv p—p, 2 kHz. The bias voltage of 1.2 kv p—p to 2.0 p—p , 300 Hz to 2 kHz is available for better discharge. In addition, at the downstream side of the discharge device 37, a pre-charging roller 41 for charging the conveyor belt 11 as a charging means is provided to confront the driving roller 19 and is in contact with the conveyor belt 11. The pre-charging roller 41 is made of stainless steel and is connected to a DC power supply 43. In the embodiment, a DC bias voltage of about 2 kv is applied to the precharging roller 41. This pre-charging roller 41 charges the conveyor belt 11 when no paper is supported on the conveyor belt 11, that is between a separation of the paper P from the conveyor belt 11 and a supply of a new paper in a next image forming process, i.e., between a discharge of the conveyor belt 11 and a supply of a new paper.

An adhering roller 45 as an adhering means is provided in contact with the conveyor belt 11 so that the adhering roller 45 confronts the tension roller 18 through the conveyor belt 11. The adhering roller 45 is made of a conductive roller with a diameter of 6 mm and is connected to a DC power supply 47. This power supply 47 applies a negative bias voltage, for instance, a bias voltage of −1.5 kv. The higher bias voltage is applied to the adhering roller 45, so that a larger adhesion force of the conveyor belt 11 for adhering the paper P can be obtained. However, when a withstand bias voltage of the conveyor belt 11 is considered, a bias voltage to be applied to the adhering roller 45 is selected so that a bias voltage of approximately 3–4 kv should be formed over the paper P on the conveyor belt 11 as explained later. The adhering roller 45 charges the paper P supplied on the conveyor belt 11, which is charged by the pre-charging roller 41 to adhere the paper P on the conveyor belt 11 electrostatically.

That is, the pre-charging roller 41 charges the conveyor belt 11 by supplying a first electrical charge of a predetermined polarity and on this charged conveyor belt 11, the paper P is supplied from the paper supply cassette 25. Then the adhering roller 45 charges the surface of the supplied paper P to adhere paper P on the conveyor belt 11 by supplying a second electrical charge of a polarity opposite to the predetermined polarity.

An image forming process by the image forming apparatus of the embodiment will now be explained.

In the present apparatus of this embodiment the image forming process is performed repeatedly.

At first, when a start signal for starting the image forming is produced, the photosensitive drums 3*a*, 3*b*, 3*c* and 3*d* start to rotate. Simultaneously therewith, the driving roller 19 is driven and conveyor belt 11 begins to move in the direction of the arrow e. Photosensitive drum 3*a* is charged uniformly by the charging roller 5*a*. The charged photosensitive drum 3*a* is exposed by the exposing station 7*a* to form an electrostatic latent image. The electrostatic latent image is developed by yellow developer contained in the developing device 9*a*, and a yellow image as a color component of a color image is formed on the surface of the photosensitive drum 3*a*. In a similar way as described, a magenta image is formed on the surface of the drum 3*b*, a cyan image is formed on the surface of the drum 3*c*, and a black image is formed on the surface of the drum 3*d*.

The paper P is picked up from the paper supply cassette 25 by the pick-up roller 27 and sent to the pair of aligning rollers 29. The aligning rollers 29 send out the paper P onto the conveyor belt 11 in a predetermined timing with the rotation of the photosensitive drum 3*a*.

The supplied paper P on the conveyor belt 11 is conveyed to the fixing device 33 successively through the image forming stations 15*a*, 15*b*, 15*c* and 15*d* by way of the movement of the conveyor belt 11. In the process of the passage of the paper P through the image forming stations, at first the yellow image formed on the surface of the photosensitive drum 3*a* is transferred onto the paper P by applying a bias voltage of approximately +6 kv to the corona charger 13*a*. Then, the paper P with the yellow image formed thereon is conveyed toward the fixing device 33, and the magenta image on the surface of the photosensitive drum 3*b*, the cyan image on the surface of the photosensitive drum 3*c*, and the black image on the surface of the photosensitive drum 3*d* are successively transferred onto the surface of the paper P in superposed relationship by the corona chargers 13*b*, 13*c* and 13*d* respectively, whereby a multiplex image is formed on the surface of the paper P.

The paper P on which is formed the multiplex image is conveyed to the fixing device 33, where the multiplex image is fixed after the paper P is separated from the conveyor belt 11 by the separating device 35. The paper P carrying the fixed image is discharged on the paper tray 34.

After the paper P is separated from the conveyor belt 11, the surface of the conveyor belt 11 is cleaned by the cleaning device 36. The pre-charging roller 41 charges the conveyor belt 11 so that an electrical potential of the suface of the conveyor belt 11 is 1500 v before a new paper to be used in a next image forming process is supplied on the conveyor belt 11 again.

The conveyor belt which has no paper thereon and which is charged by the pre-charging roller 41 is moved forward to the paper supply cassette 25. When a detector 49 which is arranged between the pre-charging roller 41 and paper supply cassette 25 along the moving direction of the conveyor belt 11 detects the passage of the conveyor belt 11, a new image forming process starts again as described above.

In the new image forming process, the new paper P is supplied on the conveyor belt 11, and then the adhering roller 45 applies a bias voltage of −1.5 kv so that the adhering roller 45 charges the surface of the new paper P with a negative polarity. In this case an adhesion force of the conveyor belt 11 for adhering paper P is rather large.

Here, an adhesion of an image receiving member in the image forming apparatus will be explained in detail.

Figure 2:
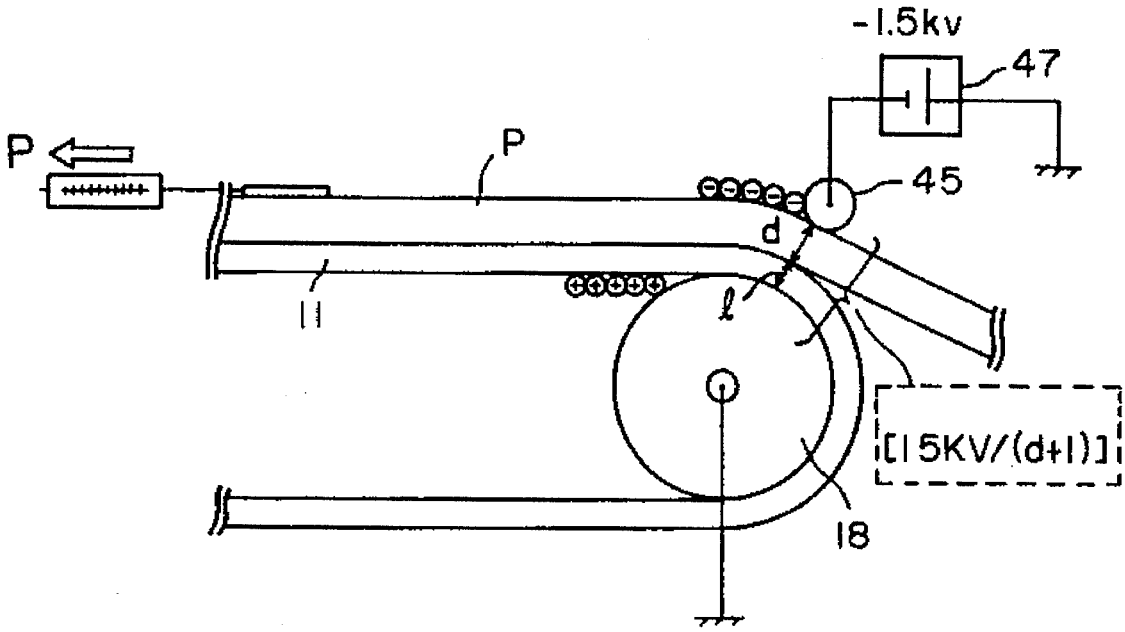
FIG. 2 is a view showing a method to measure adhesion force of a conveyor belt for adhering an image receiving member.

Adhesion force of the conveyor belt 11 for adhering paper P is measured by the method as illustrated in FIG. 2. In this method, the conveyor belt 11 supporting the paper P thereon is moved by the rotation of the driving roller 19 and the tension roller 18 and when the paper reaches the last image forming station 15*d*, the rotation of the driving roller 19 is controlled to stop. Then the conveyor belt 11 is pulled out from the image forming apparatus, and the paper P is pulled with a spring balance as indicated by the arrow in the direction P. A value of the maximum force in the spring balance at a time when the paper P moves relative to the conveyor belt is measured as a value of the adhesion force.

A principle of adhesion will now be described. If there is no charging means for charging the surface of the conveyor belt 11 such as the pre-charging roller 41, the adhesion of the paper P is enhanced only by the charging of the adhering roller 45. For example, when the adhering roller 45 applies a bias voltage of −1.5 kv, an electrical field having a potential difference of 1.5 kv is formed between the paper P and the conveyor belt 11 as shown in FIG. 2. The surface of the paper P is charged with a negative polarity by a discharge in the minute gap between the adhering roller 45 and paper P. On the other hand, the back surface of the conveyor belt 11 is charged with a positive polarity because of an induced positive charge, therefore the paper is attracted electrostatically to the conveyor belt 11.

Figure 3:
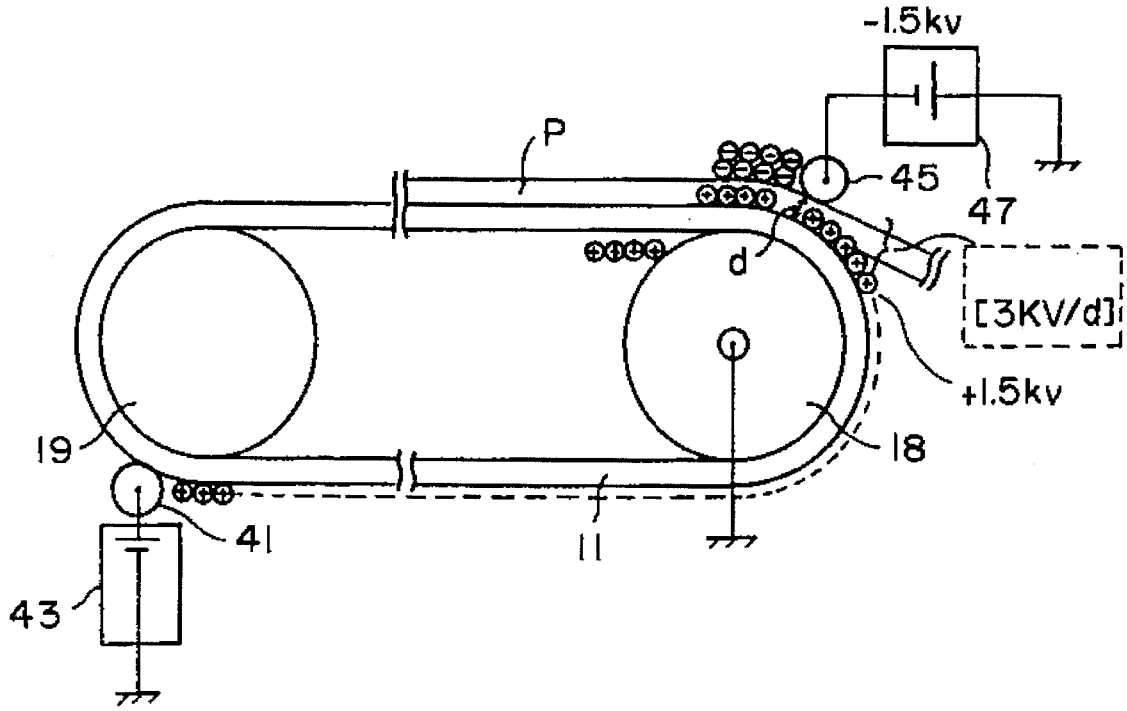
FIG. 3 is a view showing an electric field formed over the image receiving member.

The adhesion force of the conveyor belt 11 in a case of using a charging means will be described referring to FIG. 3. The bias voltage applied to the pre-charging roller 41 is selected to be opposite in polarity with respect to the bias voltage applied to the adhering roller 45. For instance, the pre-charging roller 41 receives a DC bias voltage of +2.0 kv so that the surface of the conveyor belt 11 is charged with an electrical potential of +1.5 kv. On the other hand, the adhering roller 45 applies the adhesion bias voltage of −1.5 kv when the paper P which is supplied on the charged conveyor belt 11 reaches an adhesion point.

An electrical field of a predetermined value is formed in accordance with a potential difference between the negative potential of the adhering roller 45 and the positive surface potential of the conveyor belt 11 over a predetermined distance just equivalent to the thickness of the paper P.

The value of this electrical field thus obtained is larger than that of using no pre-charging. Therefore, if the conveyor belt is precharged, much electrical charge is supplied on the paper P. As a result, the adhesion force of the conveyor belt 11 increases. That is, assuming that the thickness of the paper P is d, and the thickness of the belt is 1, the electrical field is 1.5 kV/(d+l) in the case of using no charging means and 3 kv/d in the case of using charging means.

As described above, the pre-charging by the pre-charging roller 41 increases the adhesion force of the conveyor belt 11 for adhering the paper P and enables stable conveyance of the paper P on the conveyor belt. Therefore, it is possible to form a color image on the paper P without any misregistration when an image forming process is performed in the image forming apparatus shown in FIG. 1.

Table 1 shows variation of the force for adhering the paper P in accordance with the bias voltage applied to the pre-charging roller 41 and the adhering roller 45.

As shown in the Table 1, when the polarity of the charge supplied by the pre-charging roller 41 is opposite to that supplied by the adhering roller 45, the adhesion force for adhering paper P increases.

Figure 4:
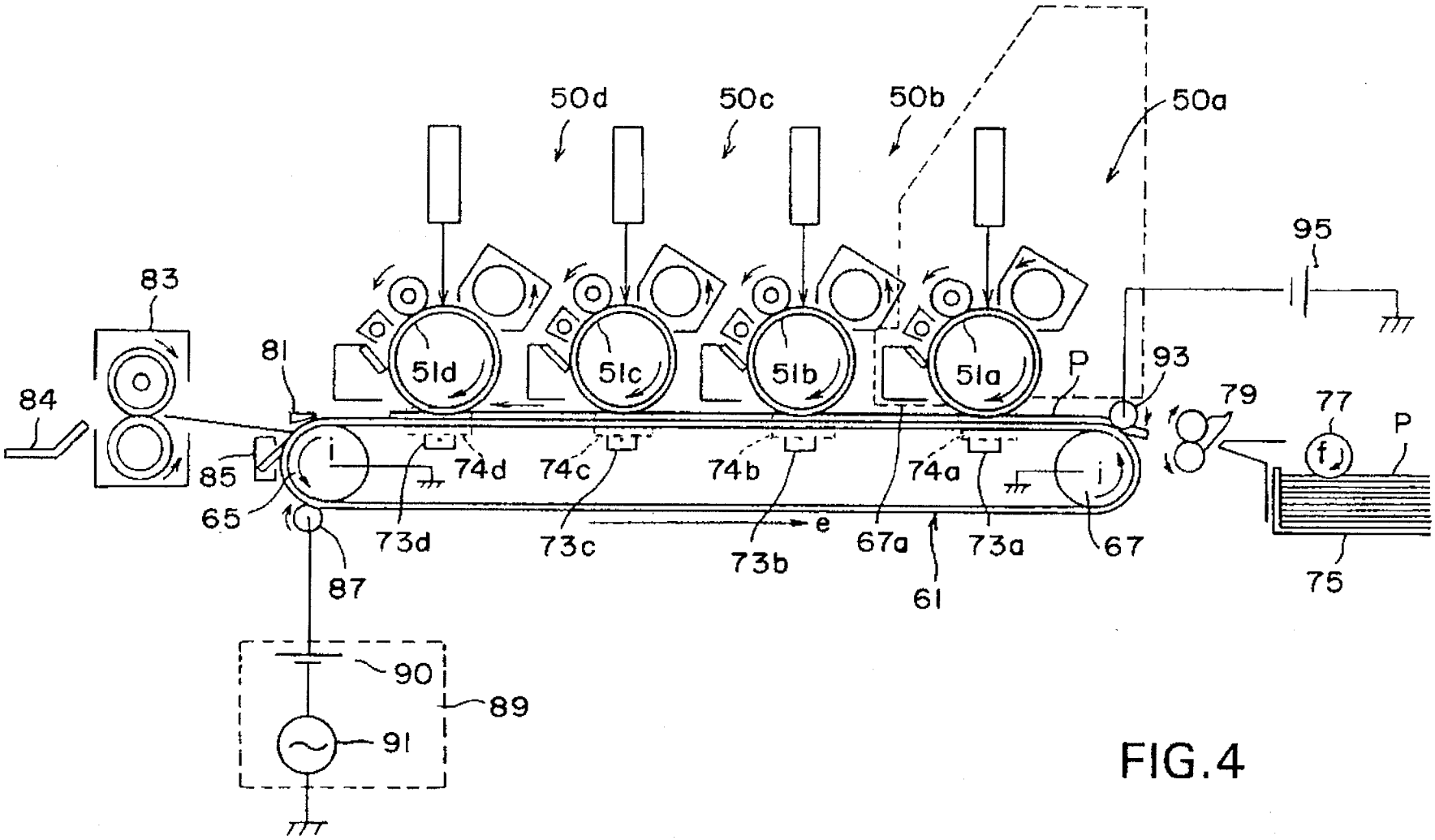
FIG. 4 is a sectional view showing the image forming apparatus of a second embodiment of the present invention.

A second embodiment of the present invention will now be described by reference to FIG. 4.

The construction of the apparatus of the second embodiment is similar to that of the first embodiment. That is, processing units 50*a*, 50*b*, 50*c* and 50*d* as a plurality of image forming means are provided, and the processing units include photosensitive drums 51*a*, 51*b*, 51*c* and 51*d* on which a developer image is formed, respectively. A conveyor belt 61 as conveying means is advanced by the rotation of a driving roller 65 and a following roller 67 as moving means and conveys a paper P picked up from a paper supply cassette 75 to the respective processing units in order. The corona chargers 73*a*, 73*b*, 73*c* and 73*d* are arranged to confront the drums 51*a*, 51*b*, 51*c* and 51*d*, respectively, to form image forming stations 74*a*, 74*b*, 74*c* and 74*d*.

In the process of the passage of the paper P through the respective image forming station, the developer images formed on the drums 51*a*, 51*b*, 51*c* and 51*d* are transferred onto the paper P in superposed relationship. The multiple developer images transferred on the paper P are separated from the conveyor belt 61 by the separating device 81, and fixed by the fixing device 83. After fixing the images, the paper P is ejected into a paper tray 84.

In this embodiment, a blade cleaning device 85 is provided in contact with the conveyor belt 61 to oppose the driving roller 65 and at the downstream side of the blade cleaning device 85 along the moving direction of the conveyor belt 61, a pre-charging roller 87 is provided. The pre-charging roller 87 is connected to a power supply 89 comprising a DC power supply 90 and an AC power supply 91. An AC superposed DC bias voltage is applied to the pre-charging roller 87 from the power supply 89.

Between the paper cassette 75 and conveyor belt 61, an adhering roller 93 as adhering means is provided in contact with the conveyor belt 61 to oppose the following roller 67. The adhering roller 93 is connected to a negative power supply 95, and the negative bias voltage is applied to this adhering roller 93 in the same manner as in the first embodiment.

In this embodiment, the AC superposed DC bias voltage, for example, +1000 V DC bias voltage and 3 kvp-p, 2 kHz AC bias voltage is applied to the pre-charging roller 87 to charge the surface of the conveyor belt 61 in positive polarity. When the charged conveyor belt 61 reaches near the paper supply cassette 75, the paper P is supplied onto the charged conveyor belt 61. The adhering roller 93 applies a negative DC bias voltage, for example −1.5 kV, to charge the surface of the supplied paper P with a negative polarity.

An image forming process in this embodiment is similar to that of the first embodiment and a detailed description is not provided. Other features of this embodimemt will be described below.

After the conveyor belt 61 sends out the paper P on which is formed a multiplex image thereon to the fixing device 83, developer adhered to the conveyor belt 61 is removed by the blade cleaning device 85. Then, the conveyor belt is charged by the pre-charging roller 87. In this case, however, since the AC superposed DC bias voltage is applied to the pre-charging roller 87, a charge accumulated on the conveyor belt 61, which is caused by the corona charge to the conveyor belt in the image transfer process, is discharged and simultaneously therewith the surface of the conveyor belt 61 is charged with a positive electrical difference.

Even if the conveyor belt 61 is charged in such a way as described above, when the adhering roller 93 supplies the conveyor belt 61 with a negative charge, a large electrical field is formed over the paper P. Therefore, the paper P is adhered on the conveyor belt firmly.

In this embodiment, there is an advantage that no discharging device is needed because the pre-charging roller 87 also serves as a discharging device.

The pre-charging roller 87 charges the surface of the conveyor belt 61 by supplying the charge of predetermined polarity while discharging the conveyor belt. The adhering roller 93 charges the surface of the paper P, which is supplied on the charged conveyor belt 61, by supplying the charge of the opposite polarity of the predetermined polarity on the paper P. In this way, the adhesion force of the conveyor belt 61 for adhering the paper P increases. Accordingly, the image forming apparatus of this embodimemt enables the stable conveyance of the paper P on the conveyor belt 61. Therefore, it is possible to form a color image on the paper P without any misregistration when an image forming process is performed in the image forming apparatus shown in FIG. 4 as well as that shown in FIG. 1.

The polarity of the charge supplied from the charging means to the conveyor belt must be in opposite relation with the polarity of the charge supplied from the adhering means to the image receiving member.

Further, it is desirable that the polarity of the charge supplied from the adhering means is also in opposite relation with the polarity of the charge supplied from the transferring means to the conveyor belt. That is, it is desirable that the polarity of the charge for the transfer of the image is the same as that for the charge of the conveyor belt.

If the polarity of the charge for the adhesion is the same as that for the transfer, the electrical field formed between the image carrier and the transfer means is weakened due to the charge hold on the surface of the paper P, so the efficiency of the image transfer goes down.

An electrical potential of the surface of the conveyor belt and a force for adhering paper which vary in accordance with the bias voltage applied to the charging means and adhering means will be described by reference to FIG. 5, FIG. 6 and Table 1.

Figure 5:
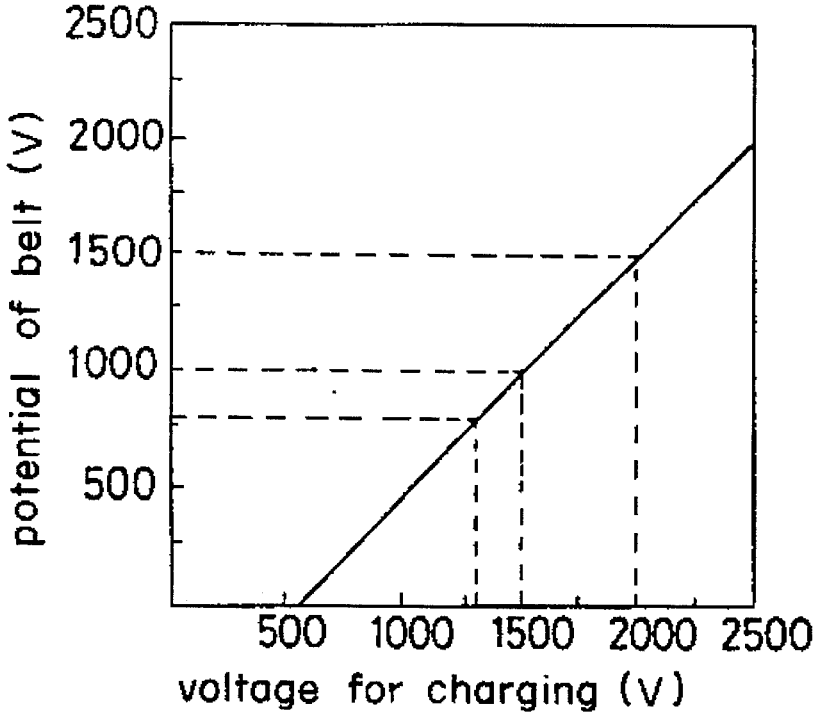
FIG. 5 and FIG. 6 are diagrams showing a relationship between a bias voltage applied to a charging roller and electrical potential of the charged conveyor belt.
Figure 6:
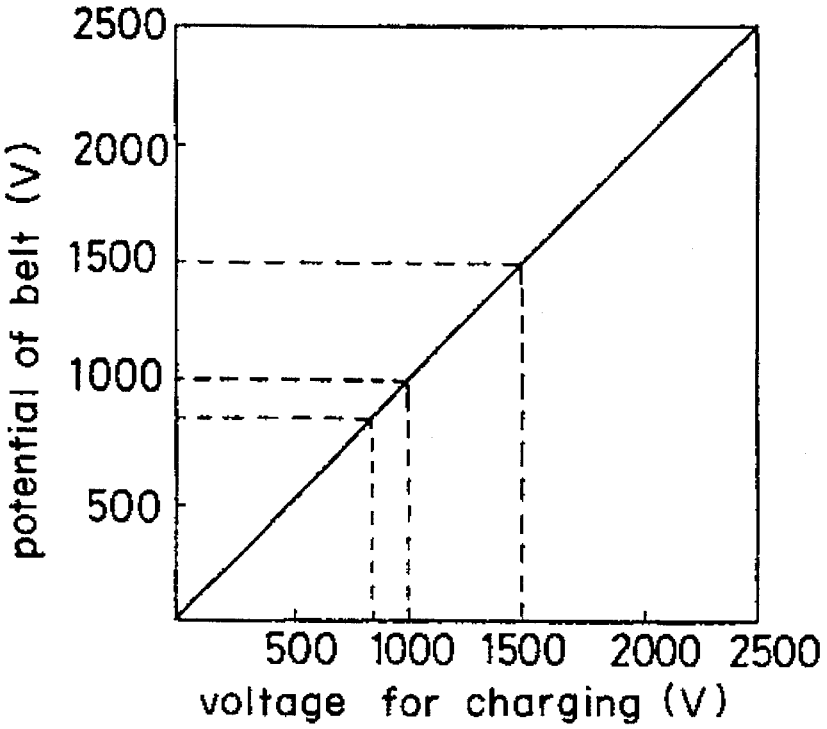

When only a DC bias voltage is applied to the charging means, the electrical potential of the conveyor belt is in proportional relation with the applied bias voltage as shown by a straight line in FIG. 5, which shows discharging starts when the applied bias voltage is 500 V. This charging characteristic is affected by an electrical resistance of the charging means but does not depend on that of the conveyor belt. The relation between the electrical potential of the charged conveyor belt and the force for adhering paper P has already been shown in Table 1.

The minimum value in a range of a bias voltage for good charging of the conveyor belt is determined depending on whether or not a sufficient adhesion force can be obtained. Since the force of approximately 1000 g is required as the adhesion force, the value of the bias voltage for charging should be selected so that the conveyor belt can hold the electrical potential of more than +1500 v when the charged conveyor belt reaches near the adhering means under a condition that the bias voltage for adhering is −1 kv. The value of the bias voltage for charging of the conveyor belt should be selected so that the conveyor belt can hold the electrical potential of more than +1000 v under a condition that the bias voltage for adhesion is −1.5 kV, and more than +800 V under the condition that the bias voltage for adhesion is −2.0 kV.

Table 2 shows these relations. As shown in the Table 2 and, the DC bias voltage of 1.3 to 2.0 kv is needed for charging the conveyor belt when the bias voltage of −2 to −1 kv is applied to the adhering means.

On the other hand the maximum value for good charging of the conveyor belt is up to a voltage which does not cause an electrical breakdown in the conveyor belt. The higher voltage produces the better adhesion, but the voltage is normally less than about 4 kv.

It is important that an electrical resistance of the conveyor belt is $10^7$ to $10^{14}$ Ωcm so as to hold the electrical charge on the surface of the conveyor belt, in addition to the control of the bias voltage applied to the charging means.

Variation of the absorption force of the conveyor belt in case of applying an AC superposed on a DC bias voltage to the charging means will now be described by reference to FIG. 6. Although the charging characteristic of the conveyor belt is affected by the condition of the AC bias voltage, it is necessary to apply the bias voltage enough to charge the conveyor belt. FIG. 6 shows the electrical potential which varies in accordance with the applied DC bias voltage when the AC bias voltage is set at 3 kvp-p, 2 kHz. There is a feature that the electrical potential of the charged conveyor belt rises from DC=0 V when AC superposed DC bias voltage is applied.

The minimum value of the bias voltage for good charging is determined depending on whether the adhesion force of more than 1000 g can be obtained, and the maximum value is up to the value to prevent an electrical breakdown of the conveyor belt. That is, the bias voltage for charging is selected so that, as the electrical potential of the charged conveyor belt, more than 1.5 kv can be obtained when the bias voltage for adhering is −1.0 kv. It is selected so that, as the electrical potential of the charged conveyor belt, more than 1.0 kv can be obtained when the bias voltage for adhesion is −1.5 kv, and more than 800 v when the bias voltage for adhesion is −2.0 kv.

Table 3 shows these relations. As seen in Table 3, the bias voltage of 0.8 to 1.5 kv is needed for charging the conveyor belt when the bias voltage of −1 to −2 kv is applied to the adhering roller.

It is important that an electrical resistance of the conveyor belt is $10^7$ to $10^{14}$ Ωcm so as to hold the electrical charge on the surface of the conveyor belt, in addition to the control of the bias voltage applied to the charging means.

Figure 7:
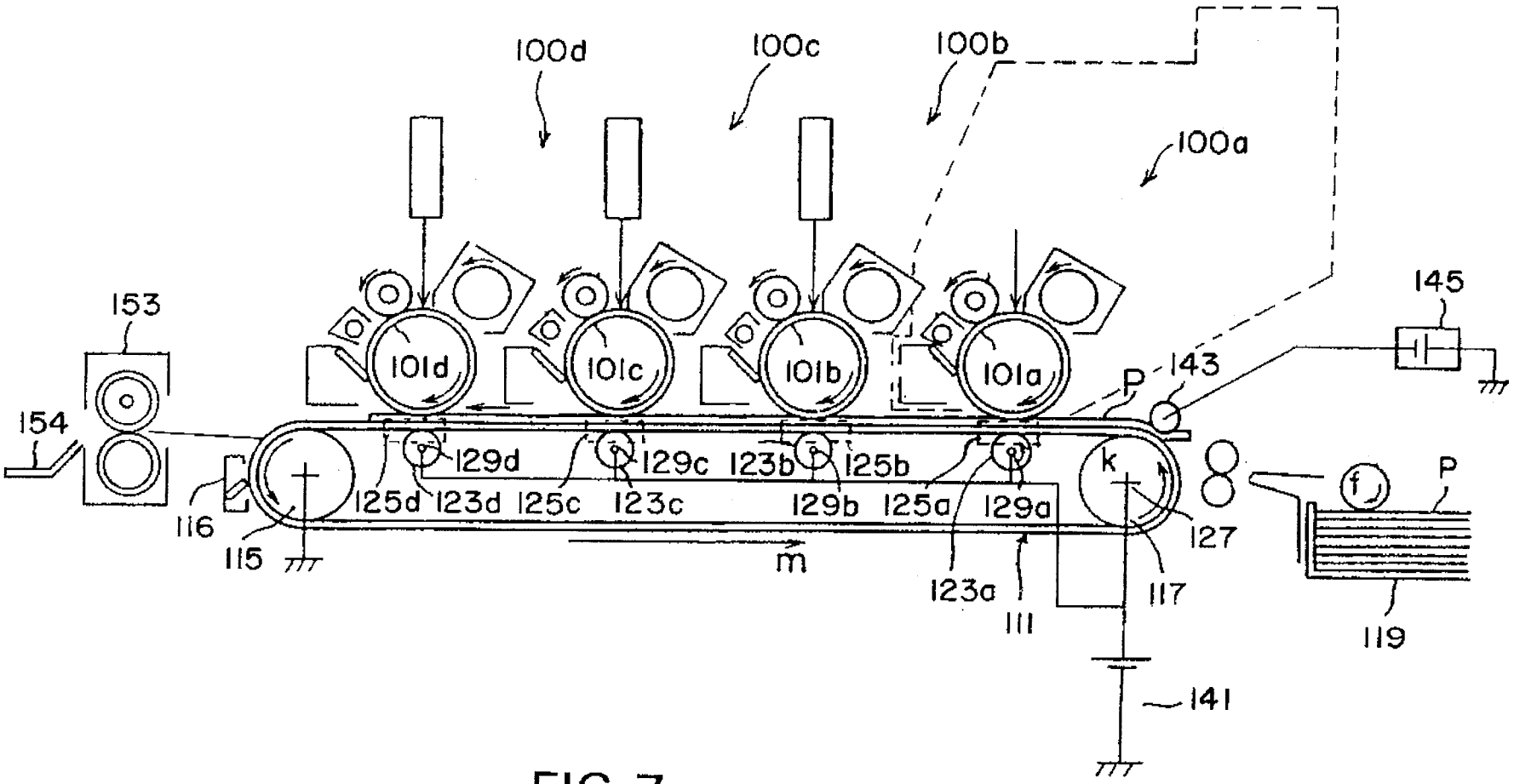
FIG. 7 is a sectional view showing the image forming apparatus of a third embodiment of the present invention.

A third embodiment of the present invention will be now described by reference to FIG. 7.

The construction of the image forming apparatus of this embodiment is similar to that of the first embodiment.

Processing units 100*a*, 100*b*, 100*c* and 100*d* are provided as a plurality of image forming means, and the processing units include photosensitive drums 101*a*, 101*b*, 101*c* and 101*d*.

In this embodiment the conveyor belt 111 as conveying means is composed of 75 weight percent of thermosetting polyimide mixed with 15 weight percent of conductive carbon particles. The surface of the conveyor belt 111 is coated with a TEFLON thin film. The conveyor belt 111 is an endless belt 350 mm in width, 80 mm in diameter, and 100 μm in thickness. It is designed to have an electrical resistance of $10^{11}$ Ωcm . The conveyor belt 111 is moved by way of a rotation of a driving roller 115 and a following roller 117 while supporting a paper P supplied from a paper supply cassette 119.

On the back face of the conveyor belt 111, a plurality of transfer rollers 123*a*, 123*b*, 123*c* and 123*d* are arranged in contact with the conveyor belt 111 to oppose the photosensitive drums 101*a*, 101*b*, 101*c* and 101*d* respectively, whereby image forming stations 125*a*, 125*b*, 125*c*, and 125*d* for forming the image on the paper P are formed. These transfer rollers rotate following the movement of the conveyor belt 111.

The following roller 117, and the transfer rollers 123*a*, 123*b*, 123*c* and 123*d* are made of conductive rubber having an electrical resistance of approximately $10^4$ Ωcm and have metallic shafts 127, 129*a*, 129*b*, 129*c* and 129*d*, respectively, in the center of them. These shafts are all connected to the same DC bias power supply 141 and the rollers are supplied with a bias voltage of a positive polarity from the power supply 141.

Further, an adhering roller 143 is provided to confront the following roller 117 through the conveyor belt 111. The adhering roller 143 is connected to a negative power supply 145 and receives a bias voltage of a negative polarity from power supply 145.

In the image forming process of the image forming apparatus of this embodiment too, a color image is formed on the paper P in a similar way as described above. Features of this embodiment will be described below.

After one cycle of an image forming process is completed, the conveyor belt 111 which has no paper thereon moves forward to the paper supply cassette 119 for a new image forming process. A developer image is formed on each of the photosensitive drums and in the predetermined timing with the image forming process, the paper P is supplied on the conveyor belt 111. When a leading edge of the paper P reaches just between the adhering roller 143 and the following roller 117, the bias voltage of −1.5 kv is applied to adhering roller 143 from the power supply 145, and simultaneously the bias voltage of +1.5 kv is applied to the following roller 117, and transfer rollers 124*a*, 124*b*, 124*c* and 124*d* from the power supply 141.

As a result, the front surface of the paper P contacting the adhering roller 143 is charged in negative polarity and the back surface of the paper P contacting the conveyor belt 111 is charged in positive polarity. Due to the electrostatic force resulting from this charging, it is possible to adhere the paper P on the conveyor belt 111 sufficiently.

If the pre-charging means is provided far from the adhering means, the charge supplied on the conveyor belt from the charging means decays while the charged conveyor belt reaches the adhering means. However, in this embodiment, the decay of the charge supplied from the following roller 117 on the conveyor belt 111 does not occur.

When the conveyor belt 111 with adhered paper P thereon is advanced to the image forming station 125*a*, 125*b*, 125*c* and 125*d* in succession, as the transfer rollers 123*a*, 123*b*, 123*c* and 123*d* apply the bias voltage of +1.5 kv, the multiple images are superposed on the paper P in order. These images transferred to the paper P are fixed by a fixing device 153. Accordingly, a color image can be formed on the paper P without any misregistration.

As described above, since the charge of a predetermined polarity is supplied on the surface of the conveyor belt 111 from the following roller 117 as charging means, and the charge of a polarity opposite to the predetermined polarity is supplied on the surface of the paper P from the adhering roller 143, a large electrical field is formed across the thickness of the paper P. Therefore adhesion force for adhering paper P increases.

Further, as seen in this embodiment, if the following roller 117 and transfer rollers 123*a*, 123*b*, 123*c* and 123*d* are all connected to only one power supply in parallel, the number of power supplies can be reduced. Even if a power supply of about 2 kv is used, sufficient adhesion force can be obtained. Thus, the image forming apparatus of this embodimemt enables a downsizing of the apparatus and cost reduction of the apparatus too.

As described above, according to the present invention, it is possible to increase the adhesion force for adhering an image receiving member on a conveying means, and to convey the paper stably. Further it is possible to form a color image on the receiving member without any misregistration in the color image forming process.

TABLE 1

| bias voltage for applying to the adhering roller | bias voltage for applying to the charging roller | electrical potential of the charged conveyor belt | adhesion force (g) |
|---|---|---|---|
| −1 kV | AC (3 kVpp, 2 kHz) | 0 V | 200 |
| | AC + DC (+500 V) | +500 V | 500 |
| | AC + DC (+1000 V) | +1000 V | 800 |
| | DC (+2000 V) | +1500 V | 1000 |
| −1.5 kV | AC (3 kVpp, 2 kHz) | 0 V | 300 |
| | AC + DC (+500 V) | +500 V | 600 |
| | AC + DC (+1000 V) | +1000 V | 1000 |
| | DC (+2000 V) | +1500 V | 1300 |
| −2 kV | AC (3 kVpp, 2 kHz) | 0 V | 400 |
| | AC + DC (+500 V) | +500 V | 700 |
| | AC+ DC (+1000 V) | +1000 V | 1200 |
| | DC (+2000 V) | +1500 V | 1500 |

TABLE 2

| bias voltage for applying to the adhering roller | DC bias voltage for applying to the charging roller to obtain the adhesion force of 1000 g |
|---|---|
| −2.0 kV | more than 1.3 kV |
| −1.5 kV | more than 1.5 kV |
| −1.0 kV | more than 2.0 kV |

TABLE 3

| bias voltage for applying to the adhering roller | DC bias voltage for applying to the charging roller to obtain the adhesion force of 1000 g |
|---|---|
| −2.0 kV | more than 0.8 kV |
| −1.5 kV | more than 1.0 kV |
| −1.0 kV | more than 1.5 kV |

What is claimed is:

1. An image forming apparatus for forming an image on an image receiving member, comprising:

means for forming the image on an image carrier;

means, confronting the image carrier, for transferring the image formed on the image carrier onto the image receiving member;

means for conveying the image receiving member to the transferring means while supporting the image receiving member thereon;

means for charging the conveying means by supplying a first electrical charge of a predetermined polarity to the conveying means, the charging means including a first charging member provided in contact with the conveying means and a first power supply for applying a DC bias voltage in the range of 1.3 to 2.0 kv to the first charging member;

means for supplying the image receiving member onto the conveying means charged by the charging means; and means for adhering the image receiving member supplied by the supplying means onto the conveying means by supplying a second electrical charge of polarity opposite to the predetermined polarity to the image receiving member, the adhering means including a second charging member provided in contact with the image receiving member and a second power supply for applying a DC bias voltage in the range of −1 to −2 kv to the second charging member.

2. An image forming apparatus for forming an image on an image receiving member, comprising:

means for forming the image on an image carrier;

means, confronting the image carrier, for transferring the image formed on the image carrier onto the image receiving member;

means for conveying the image receiving member to the transferring means while supporting the image receiving member thereon;

means for charging the conveying means by supplying a first electrical charge of a predetermined polarity to the conveying means, the charging means including a first charging member provided in contact with the conveying means and a first power supply for applying an AC bias voltage superposed on a DC bias voltage to the first charging member;

means for supplying the image receiving member onto the conveying means charged by the charging means; and means for adhering the image receiving member supplied by the supplying means onto the conveying means by supplying a second electrical charge of a polarity opposite to the predetermined polarity to the image receiving member, the adhering means including a second charging member and a second power supply for applying a predetermined bias voltage.

3. An image forming apparatus according to claim 2, wherein said DC bias voltage is in the range of 0.8 to 1.5 kv when the second power supply applies a DC voltage in the range of −1 to −2 kv to the second charging member.

4. An image forming apparatus for forming an image on an image receiving member, comprising:

means for forming the image on an image carrier;

means, confronting the image carrier, for transferring the image formed on the image carrier onto the image receiving member;

means for conveying the image receiving member to the transferring means while supporting the image receiving member thereon;

means for charging the conveying means by supplying a first electrical charge of a predetermined polarity to the conveying means, the charging means including a member for moving the conveying means and a power supply for applying a bias voltage to the moving member and the transferring means;

means for supplying the image receiving member onto the conveying means; and means, confronting the moving member through the conveying means, for adhering the image receiving member supplied by the supplying means onto the conveying means by supplying a second electrical charge of a polarity opposite to the predetermined polarity to the image receiving member.

5. A method for forming an image on an image receiving member supported on a conveying means, comprising the steps of:

forming the image on an image carrier;

charging the conveying means with a first electrical charge of a predetermined polarity, the charging step including a step of supplying an AC bias voltage superposed on a DC bias voltage to the conveying means;

supplying the image receiving member onto the charge conveying means;

adhering the supplied receiving member to the conveying means by charging the image receiving member with a second electrical charge of a polarity opposite to the predetermined polarity;

conveying the adhered image receiving member to the image carrier on which the image is formed; and transferring the image on the image carrier onto the conveyed image receiving member.

* * * * *